US011756517B2

(12) United States Patent
Schellenberg

(10) Patent No.: US 11,756,517 B2
(45) Date of Patent: Sep. 12, 2023

(54) MULTI-AXIS FOOT PEDAL FOR ELECTRIC MUSICAL INSTRUMENTS

(71) Applicant: Sonja Schellenberg, Hanau (DE)

(72) Inventor: Sonja Schellenberg, Hanau (DE)

( * ) Notice: Subject to any disclaimer, the term of this patent is extended or adjusted under 35 U.S.C. 154(b) by 0 days.

(21) Appl. No.: 17/622,878

(22) PCT Filed: Jul. 23, 2020

(86) PCT No.: PCT/EP2020/070848

§ 371 (c)(1),
(2) Date: May 10, 2022

(87) PCT Pub. No.: WO2021/013953

PCT Pub. Date: Jan. 28, 2021

(65) Prior Publication Data

US 2022/0351709 A1 Nov. 3, 2022

(30) Foreign Application Priority Data

Jul. 24, 2019 (DE) ..... 10 2019 120 024.5

(51) Int. Cl.
*G10H 1/34* (2006.01)
*G10H 1/00* (2006.01)

(52) U.S. Cl.
CPC ..... *G10H 1/348* (2013.01); *G10H 1/0008* (2013.01); *G10H 1/0091* (2013.01); *G10H 2220/275* (2013.01)

(58) Field of Classification Search
CPC .... G10H 1/348; G10H 1/0008; G10H 1/0091; G10H 2220/275
See application file for complete search history.

(56) References Cited

U.S. PATENT DOCUMENTS 4,245,539 A 1/1981 Jones
4,817,950 A * 4/1989 Goo ..... A63F 13/807 482/901
5,812,114 A 9/1998 Loop
5,982,355 A * 11/1999 Jaeger ..... G06F 3/0421 345/161
6,011,212 A * 1/2000 Rigopulos ..... G10H 1/42 84/610
6,225,977 B1 * 5/2001 Li ..... G06F 3/0334 463/36

(Continued)

FOREIGN PATENT DOCUMENTS

DE 3621172 A1 1/1998
DE 10348503 A1 5/2005

(Continued)

*Primary Examiner* — Jianchun Qin

(57) ABSTRACT

A control device (1) for controlling the sound of an electric musical instrument has a tread plate (2) and a signal generator (3). The tread plate (2) is mounted pivotally about a first axis (4*a*) and is mounted pivotally about a second axis (4*b*). The signal generator is configured such that it generates a first electrical signal for controlling the sound and a second electrical signal for controlling the sound, the first electrical signal being the result of a rotation of the tread plate (2) about the first axis (4*a*) and the second electrical signal being the result of a rotation of the tread plate (2) about the second axis (4*b*). A control system comprises a control device of this type and the electric musical instrument.

18 Claims, 12 Drawing Sheets

(56) References Cited

U.S. PATENT DOCUMENTS

| | | | | |
|---|---|---|---|---|
| 7,304,232 | B1 * | 12/2007 | Nicholes | G10H 3/182 84/741 |
| 8,338,689 | B1 | 12/2012 | Beaty | |
| 2006/0156903 | A1 | 7/2006 | Baird et al. | |
| 2016/0328028 | A1 * | 11/2016 | Khojasteh | A63F 13/213 |
| 2017/0024980 | A1 | 1/2017 | Simon | |

FOREIGN PATENT DOCUMENTS

| | | | |
|---|---|---|---|
| DE | 202008016247 | * | 4/2009 |
| GB | 2230125 A | | 6/1998 |

* cited by examiner

MULTI-AXIS FOOT PEDAL FOR ELECTRIC MUSICAL INSTRUMENTS

TECHNICAL AREA

The present invention relates to a control device for controlling a sound of an electric musical instrument. In particular, the present invention may relate to a foot pedal for controlling two or more control variables for interactive sound shaping of an electrically-amplified musical instrument.

PRIOR ART

The sound of a musical instrument is electrically amplified in many cases and the sound is electrically changed (e.g., effects device). The sound change may be changed in one or more control variables, depending on the equipment used. In general, the human-machine interface is characterized by operating elements, like rotary knobs, switches/push buttons, or graphic user interfaces. When playing music, only a few of these control variables are directly accessible for many instrumentalists, since both hands are used to play the instrument (e.g., guitar). One alternative as an input possibility that may be simultaneously operated is the use of foot pedals.

In addition to pure switching functions, swell pedals for continuous adjustment of the volume ("volume pedals"), of a tunable filter ("wah-wah"), or of another variable ("expression pedal") are common. The limitation to one single continuously adjustable variable, which is optionally supplemented with a switching function, is common to all.

For many electric musical instruments, it is possible to change two or more variables by means of a track pad/touch pad or a pointing device. These operating elements offer profound potentials for influencing the sound; however, they must be operated using hands, and are therefore not practical for many instrumentalists.

BRIEF DESCRIPTION OF THE INVENTION

The present invention relates to a control device for controlling a sound of an electric musical instrument, wherein the control device comprises: a tread plate, which is arranged to be rotatable about a first axis and is arranged to be rotatable about a second axis; and a signal generator, which is configured such that it generates a first electric signal to control the sound and a second electric signal to control the sound, wherein the first electric signal is based on a rotation of the tread plate about the first axis, and the second electric signal is based on a rotation of the tread plate about the second axis.

Furthermore, the present invention relates to a control system, which comprises the control device and the electric musical instrument.

Using the control device of the present invention, it is possible to control a sound of an electric musical instrument by rotating the tread plate about a first axis and about a second axis. A first electric signal is generated by rotating about the first axis, and a second electric signal is generated by rotating about the second axis, and a sound of the electric musical instrument may be controlled with the aid of these two signals.

This allows, for example, a user of the control device to play the electric musical instrument with both hands and simultaneously to operate the control device with a foot, in that the user rotates the tread plate about the first and/or the second axis. Thus, the user may simultaneously and continuously change, in particular, two or more parameters of the sound through a movement of his foot, while he plays the electric musical instrument with both hands. In this way, novel sound experiences may be created and the artistic expression may be intensified.

DESCRIPTION OF THE EMBODIMENTS

Figure 1A:
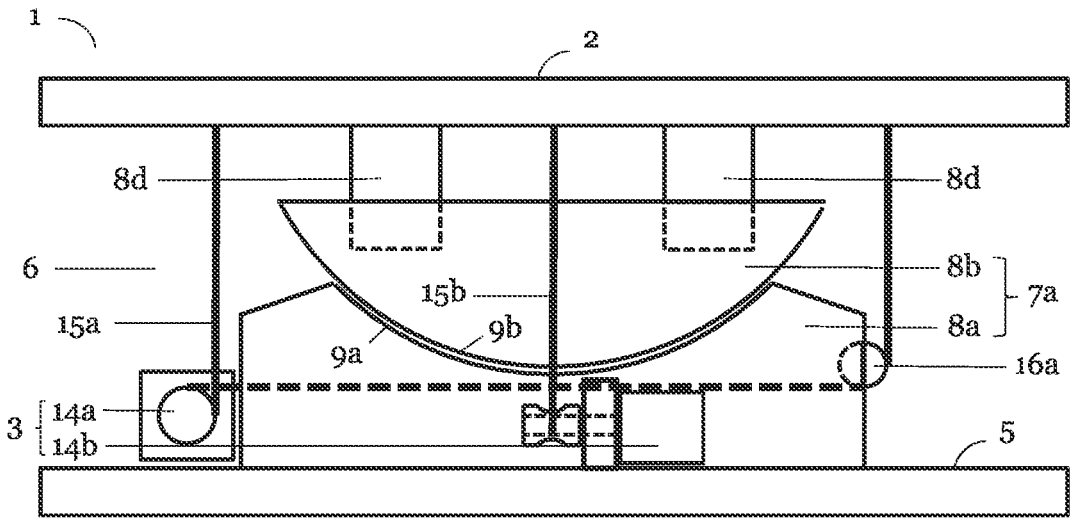
FIG. 1A shows a right side view of control device (1) according to one embodiment of the present invention with two articulations (7*a*, 7*b*), two potentiometers (14*a*, 14*b*), and two associated Bowden cables, when tread plate (2) is located in a neutral position.
Figure 1B:
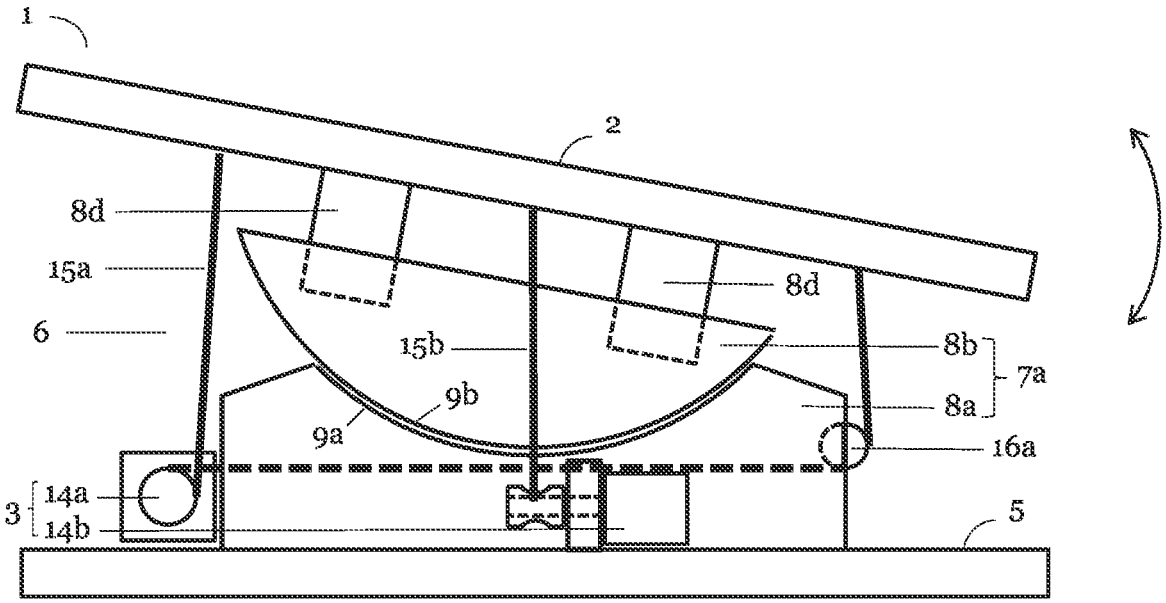
FIG. 1B shows a right side view of control device (1) according to the embodiment of the present invention with two articulations (7*a*, 7*b*), two potentiometers (14*a*, 14*b*), and two associated Bowden cables, when tread plate (2) is located in a deflected position.
Figure 1C:
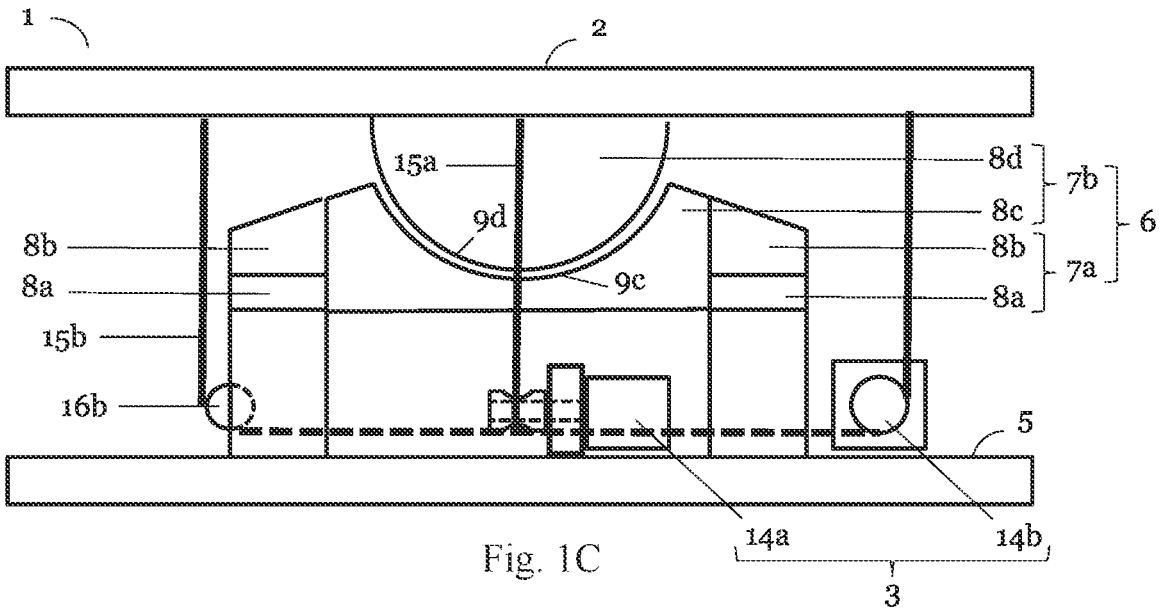
FIG. 1C shows a front view of control device (1) according to the embodiment of the present invention with two articulations (7*a*, 7*b*), two potentiometers (14*a*, 14*b*), and two associated Bowden cables, when tread plate (2) is located in a neutral position.
Figure 1D:
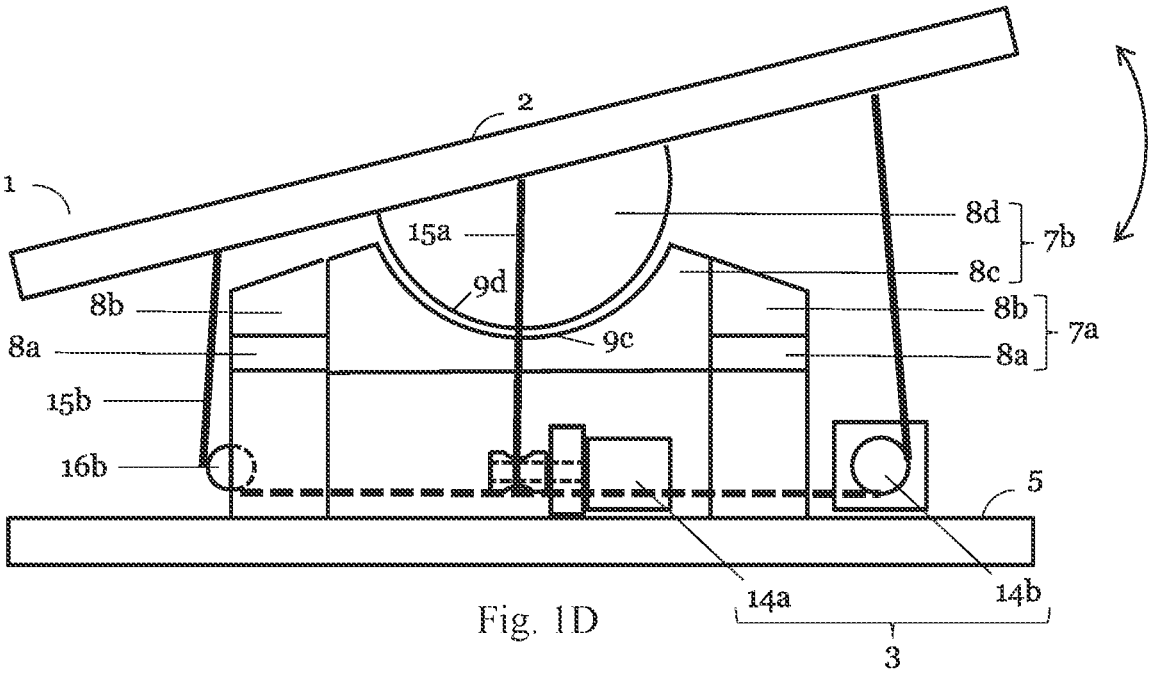
FIG. 1D shows a front view of control device (1) according to the embodiment of the present invention with two articulations (7*a*, 7*b*), two potentiometers (14*a*, 14*b*), and two associated Bowden cables, when tread plate (2) is located in a deflected position.
Figure 1E:
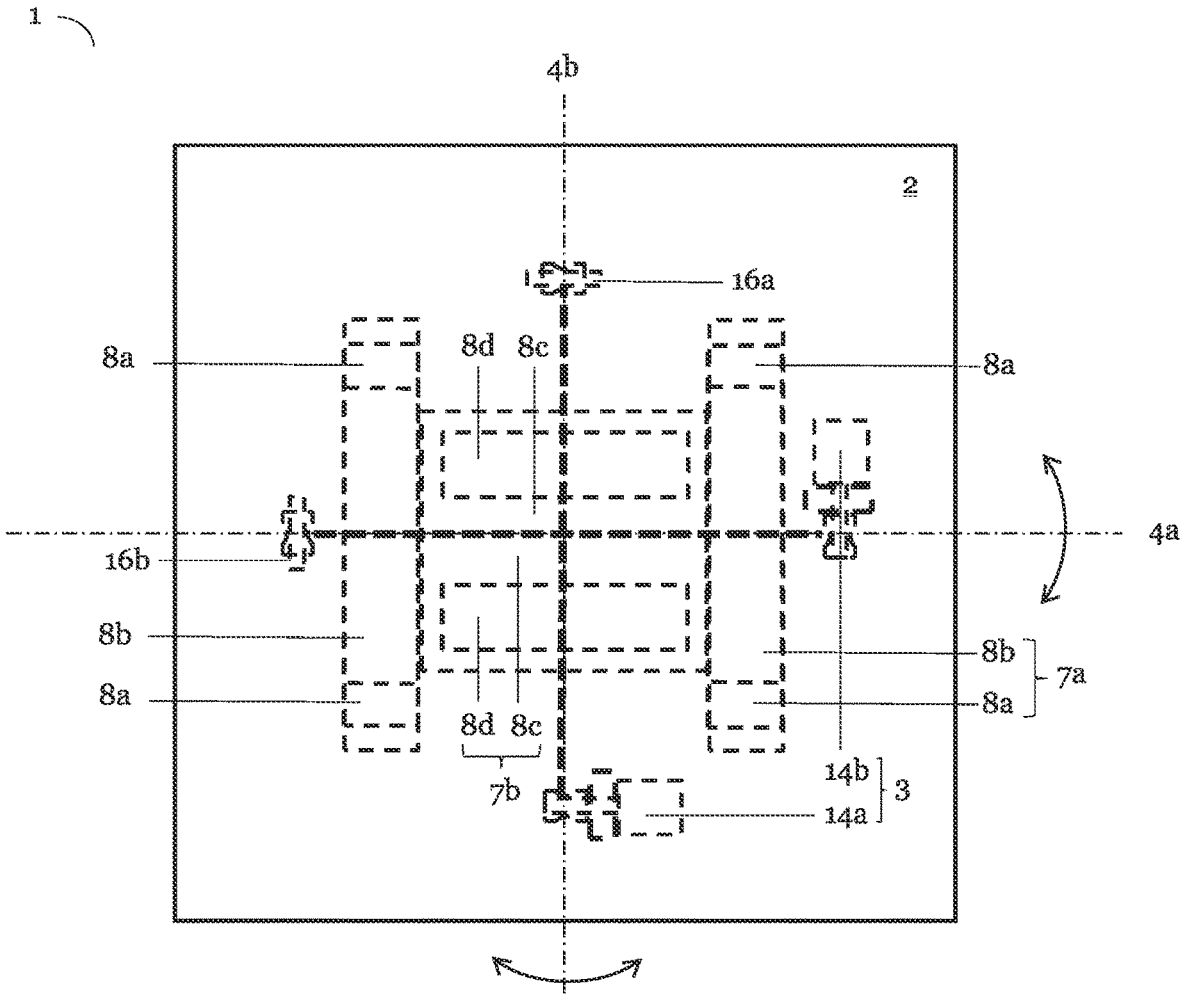
FIG. 1E shows a top view of control device (1) according to the embodiment of the present invention with two articulations (7*a*, 7*b*), two potentiometers (14*a*, 14*b*), and two associated Bowden cables.

Exemplary embodiments of the present invention will subsequently be described with reference to the drawings.

According to one aspect of the present invention, a control device (1) for controlling a sound of an electric musical instrument comprises: a tread plate (2), which is arranged to be rotatable about a first axis (4*a*) and is arranged to be rotatable about a second axis (4*b*); and a signal generator (3), which is configured such that it generates a first electric signal to control the sound and a second electric signal to control the sound, wherein the first electric signal is based on a rotation of tread plate (2) about first axis (4*a*) and the second electric signal is based on a rotation of tread plate (2) about second axis (4*b*).

This allows, for example, an artist to play the electric musical musical instrument with both hands and simultaneously rotate the tread plate with a foot about the first and/or the second axis. By this means, the artist may change the two parameters of the sound, while he plays the electric musical instrument with both hands. Thus, novel sound experiences may be created and the artistic expression may be intensified.

The first axis (4*a*) may run parallel to tread plate (2). Alternatively, the first axis may define a first axis angle with the tread plate, wherein the first axis angle is greater than 0° and less than 90°. A first axis angle of 0° corresponds to the case in which the first axis runs parallel to tread plate (2), and a first axis angle of 90° corresponds to the case in which the first axis runs perpendicular to tread plate (2). The first axis angle may be, for example, 0°, 5°, 10°, 20°, 30°, or 40°. The second axis (4*b*) may run parallel to tread plate (2). Alternatively, the second axis may define a second axis angle with the tread plate, wherein the second axis angle is greater than 0° and less than 90°. The second axis angle may be, for example, 0°, 5°, 10°, 20°, 30°, or 40°. In a first example, first axis (4*a*) and second axis (4*b*) may each run parallel to tread plate (2). In a second example, first axis (4*a*) may run parallel to tread plate (2) and second axis (4*b*) may define an axis angle between 0° and 90° (thus more than 0° and less than) 90° with the tread plate, or vice versa. In a third example, first axis (4*a*) may define a first axis angle between 0° and 90° (thus more than 0° and less than) 90° with the tread plate, and second axis (4*b*) may define a second axis angle between 0° and 90° with the tread plate. The first and the second axis angles may be the same or different. The previously mentioned settings of the two axes (4*a*, 4*b*) relative to tread plate (2) may facilitate the operation of tread plate (2) for a user and thereby facilitate the control of the sound through the respective rotations of tread plate (2) about the two axes (4*a*, 4*b*).

The signal generator (3) may be configured such that it generates the first signal in reaction to the rotation of tread plate (2) about first axis (4*a*) and generates the second signal in reaction to the rotation of tread plate (2) about second axis (4*b*). When tread plate (2) is rotated about first axis (4*a*), signal generator (3) may generate the first signal. When tread plate (2) is rotated about second axis (4*b*), signal generator (3) may generate the second signal. A deflected position designates a state of tread plate (2), in which tread plate (2) is rotated, starting from the neutral position, about first axis (4*a*) or about second axis (4*b*).

Furthermore, the first signal may depend on a first angle of rotation of tread plate (2) about first axis (4*a*), and the second signal may depend on a second angle of rotation of tread plate (2) about second axis (4*b*).

Furthermore, the first signal may be configured such that it controls a first parameter of the sound, and the second signal may be configured such that it controls a second parameter of the sound, wherein the first and the second parameters of the sound may differ from one another. The first and/or the second parameter of the sound may be a continuous parameter, like a volume (as with a "volume pedal), a tunable filter (as with a "wah-wah"), or another variable (as with an "expression pedal). The first and/or the second parameter may be, in particular, a continuously adjustable variable. The first and/or the second parameter may be continuously changed, in that an angle of rotation of tread plate (2) is continuously changed about the respective axis. The first parameter may thereby be set as increasing, the larger or smaller the first angle of rotation. The second parameter may thereby be set as increasing, the larger or smaller the second angle of rotation. However, the first and/or the second parameter does not necessarily have to increase monotonically or decrease monotonically depending on the respective angle of rotation. Thus, a user of control device (1) may control multiple parameters of the sound simultaneously in diverse ways through a movement of tread plate (2). In particular, two or more parameters may thereby be simultaneously and continuously changed by a movement of a foot. Thus, new sound experiences may be created and the artistic expression may be intensified.

Furthermore, the first electric signal may be configured such that it controls a first sound or first sound effect, and the second electric signal may be configured such that it controls a second sound or second sound effect, wherein the first sound or first sound effect may be different from the second sound or second sound effect, and wherein the resulting sound of the electric musical instrument (1) is based on the first sound or first sound effect and on the second sound or second sound effect.

In other words, not merely individual parameters of the sound may be controlled with the aid of control device (1), but entire sounds or sound effects may be controlled. In particular, entire sounds or sound effects may be mixed with one another or converted into one another by the rotation of the tread plate about first axis (4*a*) and second axis (4*b*). Thus, new sound experiences may be created and the artistic expression may be intensified.

In particular, control device (1) may be configured such that it receives a first electric sound effect signal to control a first sound effect and a second electric sound effect signal to control a second sound effect. The first electric signal may control the first sound effect, in that it adapts, amplifies, attenuates, or modulates the first electric sound effect signal, and the second electric signal may control the second sound effect, in that it adapts, amplifies, attenuates, or modulates the second electric sound effect signal.

In other words, control device (1) may be used as a 2-in-1 mixing console. The first and the second sound effect signals may be externally supplied to control device (1) and the intensities of the first and the second sound effect signals may be adapted by the movement of tread plate (2) about first axis (4*a*) or about second axis (4*b*). Thus, a cross-fade between the first and the second sound effect may be comfortably carried out in one movement, or the first and/or the second sound effect may be reduced to a minimum. For example, the electric musical instrument may be a guitar, which has a magnetic pickup and a piezo pickup. Each of the signals may then be connected to the device, and both the volume and also the mixing ratio may be controlled by an inclination of the tread plate. Thus, new sound experiences may be created and the artistic expression may be intensified.

According to one aspect of the invention, the first signal is independent of the rotation of tread plate (2) about second axis (4*b*), and the second signal is independent of the rotation of tread plate (2) about first axis. This enables the user to easily set the first and the second signals precisely through different rotations of tread plate (2). In particular, the first and the second parameters of the sound may thereby be set precisely and independently from one another.

The first signal may also depend on the rotation of the tread plate about second axis (4*b*), and the second signal may also depend on the rotation of tread plate (2) about the second axis. For example, the two parameters of the sound may thereby be changed depending on one another. For example, the dependency of the first signal on an angle of rotation of tread plate (2) about first axis (4*a*) may differ, depending on the size of the angle of rotation of tread plate (2) about second axis (4*b*). In this way, a plurality of complex and new sound experiences may be created and the artistic expression may be intensified.

According to one aspect of the invention, first axis (4*a*) has a first distance from the tread plate and second axis (4*b*) has a second distance from tread plate (2), wherein the first distance is equal to the second distance. Furthermore, the first distance and/or the second distance may equal zero, so that first axis (4*a*) and/or second axis (4*b*) lies in the tread plate. Furthermore, first axis (4*a*) and second axis (4*b*) may be arranged perpendicular with respect to one another. This allows a user to operate tread plate (2) and thereby to control the sound through the respective rotations of tread plate (2) about the two axes.

The first angle of rotation may be variable in a first interval between a first minimal angle of rotation and a first maximum angle of rotation, for example, between −22° and +22°, between −20° and +20°, between −15° and +15°, or between −10° and +10°. The second angle of rotation may be variable in a second interval between a second minimum angle of rotation and a second maximum angle of rotation, for example, between −40° and +40°, between −30° and +30°, between −20° and +20°, between −15° and +15°, or between −10° and +10°. The first minimum angle of rotation does not have to equal the negative first maximum angle of rotation, i.e., the first angle or ration may also be variable, for example, in an interval between −22° and +15°. This also applies for the second angle of rotation.

A user of control device (1) may use control device (2[sic:1]) as a foot pedal. In this case, the user places one foot on tread plate (2), so that tread plate (2) is rotated about first axis (4*a*) when the user rotates their foot about first axis (4*a*), and the tread plate may also be rotated about second axis (4*b*) when the user rotates their foot about second axis (4*b*). The first minimal angle of rotation, the first maximum angle of rotation, the second minimum angle of rotation, and the second maximum angle of rotation may each be set such that they correspond to a possible or a comfortable rotation of a foot or ankle of the user about the respective axis (4*a*, 4*b*). This facilitates the operation of tread plate (2) for a user and thereby facilitates the control of the sound through the respective rotations of tread plate (2) about the two axes.

The control device (1) may further have a support surface (5) and a bearing (6). The bearing connects tread plate (2) to support surface (5), so that tread plate (2) is arranged to be rotatable about first axis (4*a*) and about second axis (4*b*). When a user uses control device (1) as a foot pedal, support surface (5) may rest on solid ground, for example, on a floor.

The control device (1) may be configured such that tread plate (2) automatically returns to the neutral position when no external torque is exerted on tread plate (2). In the neutral position, tread plate (2) may be arranged parallel to support surface (5). The automatic return to the neutral position may be implemented by a reset mechanism, which comprises one or more compression springs. If an external torque acts on tread plate (2), for example, when a user loads tread plate (2) with a foot, the tread plate (3) is rotated about the first axis, for example, and thereby a compression spring is compressed. If the external torque becomes smaller, for example, because the user reduces the load on tread plate (2), the compression spring presses tread plate (2) in the direction of the starting position, i.e., the neutral position, using the spring force. If the external torque completely disappears, for example, because the user lifts their foot off of tread plate (2), tread plate (2) may automatically return to the neutral position.

As depicted in FIGS. 1A to 2B, the bearing may comprise a first articulation (7*a*) and a second articulation (7*b*), wherein first articulation (7*a*) is configured such that tread plate (2) is arranged to be rotatable about first axis (4*a*), and wherein second articulation (7*b*) is configured such that tread plate (2) is arranged to be rotatable about second axis (4*b*).

In particular, first articulation (7*a*) may comprise a first articulation element (8*a*) and a second articulation element (8*b*), and second articulation (7*b*) may comprise a third articulation element (8*c*) and a fourth articulation element (8*d*), wherein first articulation element (8*a*) is fixed to support surface (5), and wherein second articulation element (8*b*) is connected to first articulation element (8*a*) so that second articulation element (8*b*) is rotatable about first axis (4*a*), and wherein third articulation element (8*c*) is fixed to second articulation element (8*b*), and wherein fourth articulation element (8*d*) is connected to third articulation element (8*c*) so that fourth articulation element (8*d*) is rotatable about second axis (4*b*), and wherein tread plate (2) is fixed to fourth articulation element (8*d*), and wherein first articulation (7*a*) is configured such that tread plate (2) rotates about first axis (4*a*) when second articulation element (8*b*) rotates about first axis (4*a*), and wherein second articulation (7*b*) is configured such that tread plate (2) rotates about second axis (4*b*) when fourth articulation element (8*d*) rotates about second axis (4*b*).

The fixing of the different components of control device (1), for example, the articulation elements, the tread plate, and the support surface on one another may be achieved through different fixing means, for example, using screws, nails, adhesives, or welding. Furthermore, a first articulation element may comprise, for example, a curved groove, and a second articulation element may comprise a curved spring, wherein the spring engages into the groove such that the second articulation element is connected to the first articulation element and is rotatable about an axis. The first articulation element (8*a*) may comprise a first sliding surface (9*a*) and second articulation element (8*b*) may comprise a second sliding surface (9*b*), wherein first articulation (7*a*) is configured such that second articulation element (8*b*) moves relative to first articulation element (8*a*) when second sliding surface (9*b*) slides on first sliding surface (9*a*), and wherein third articulation element (8*c*) comprises a third sliding surface (9*c*) and fourth articulation element (8*d*) comprises a fourth sliding surface (9*d*), wherein second articulation (7*b*) is configured such that fourth articulation element (8*d*) moves relative to third articulation element (8*c*) when fourth sliding surface (9*d*) slides on third sliding surface (9*c*).

One or more of the sliding surfaces (9*a*, 9*b*, 9*c*. 9*d*) may be curved such that their centers of movement lie on or close to tread plate (2).

Specifically, first sliding surface (9*a*) may be a concave cylinder segment surface (9*a*) with a first radius about first axis (4*a*), second sliding surface (9*b*) may be a convex cylinder segment surface (9*b*) with the first radius about first axis (4*a*), third sliding surface (9*c*) may be a concave cylinder segment surface (9*c*) with a second radius about second axis (4*b*), fourth sliding surface (9*d*) may be a convex cylinder segment surface (9*d*) with the second radius about second axis (4*a*).

It should be observed, that control device (1), as depicted in FIGS. 1A to 2B, may comprise a left-side first articulation and a right-side first articulation, wherein the left-side first articulation and the right-side first articulation may each be first articulation (7*a*), and wherein the left-side first articulation and the right-side first articulation may be arranged on different sides of second axis (4*b*).

Furthermore, control device (1) may comprise a tread plate, wherein the tread plate comprises two parallel lateral faces, and wherein one of the two parallel lateral faces is tread plate (2) and the other of the two parallel lateral faces is a contact surface.

The left-side first articulation may comprise a left-side lateral face, which is configured such that the contact surface of the tread plate contacts the left-side lateral face when the second angle of rotation is equal to the second minimum angle of rotation. The right-side first articulation may comprise a right-side lateral face, which is configured such that the contact surface contacts the right-side lateral face when the second angle of rotation is equal to the second maximum angle of rotation.

Furthermore, the device may comprise a left-side second articulation and a right-side second articulation, wherein the left-side second articulation and the right-side second articulation may each be second articulation (7*b*), and wherein the left-side second articulation and the right-side second articulation may be arranged on different sides of first axis (4*a*).

The left-side second articulation may comprise a left-side, curved lateral face, which is configured such that the contact surface of the tread plate contacts the left-side, curved lateral face when the first angle of rotation is equal to the first minimum angle of rotation. The right-side second articulation may comprise a right-side, curved lateral face, which is configured such that the contact surface contacts the right-side, curved lateral face when the first angle of rotation is equal to the first maximum angle of rotation. In this situation, tread plate (2) is further rotatable about second axis (4*b*) due to the curvature of the respective, curved lateral face.

Figure 3A:
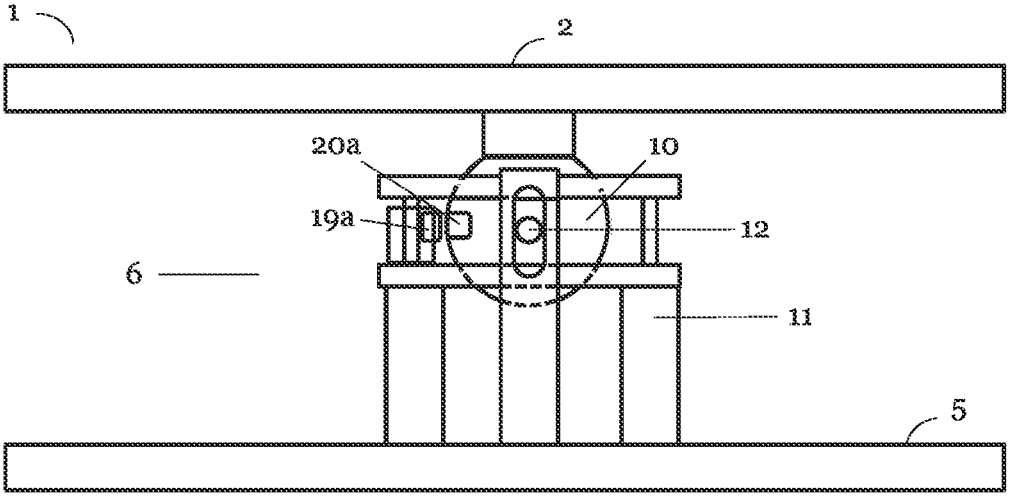
FIG. 3A shows a right side view of control device (1) according to one embodiment of the present invention with a ball joint, two Hall sensors, and two magnets.
Figure 3B:
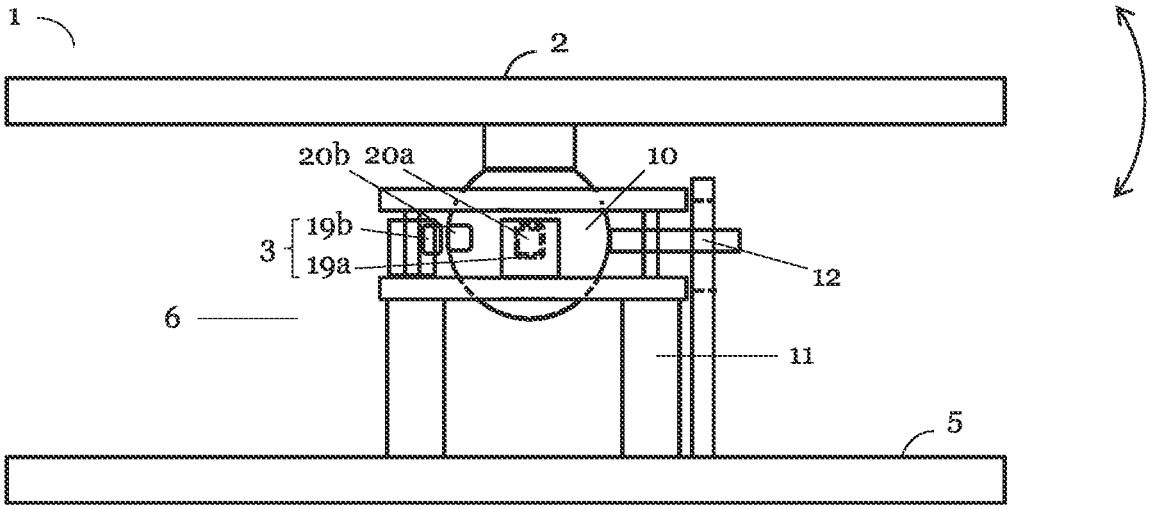
FIG. 3B shows a front view of control device (1) according to the embodiment of the present invention with a ball joint, two Hall sensors, and two magnets.
Figure 3C:
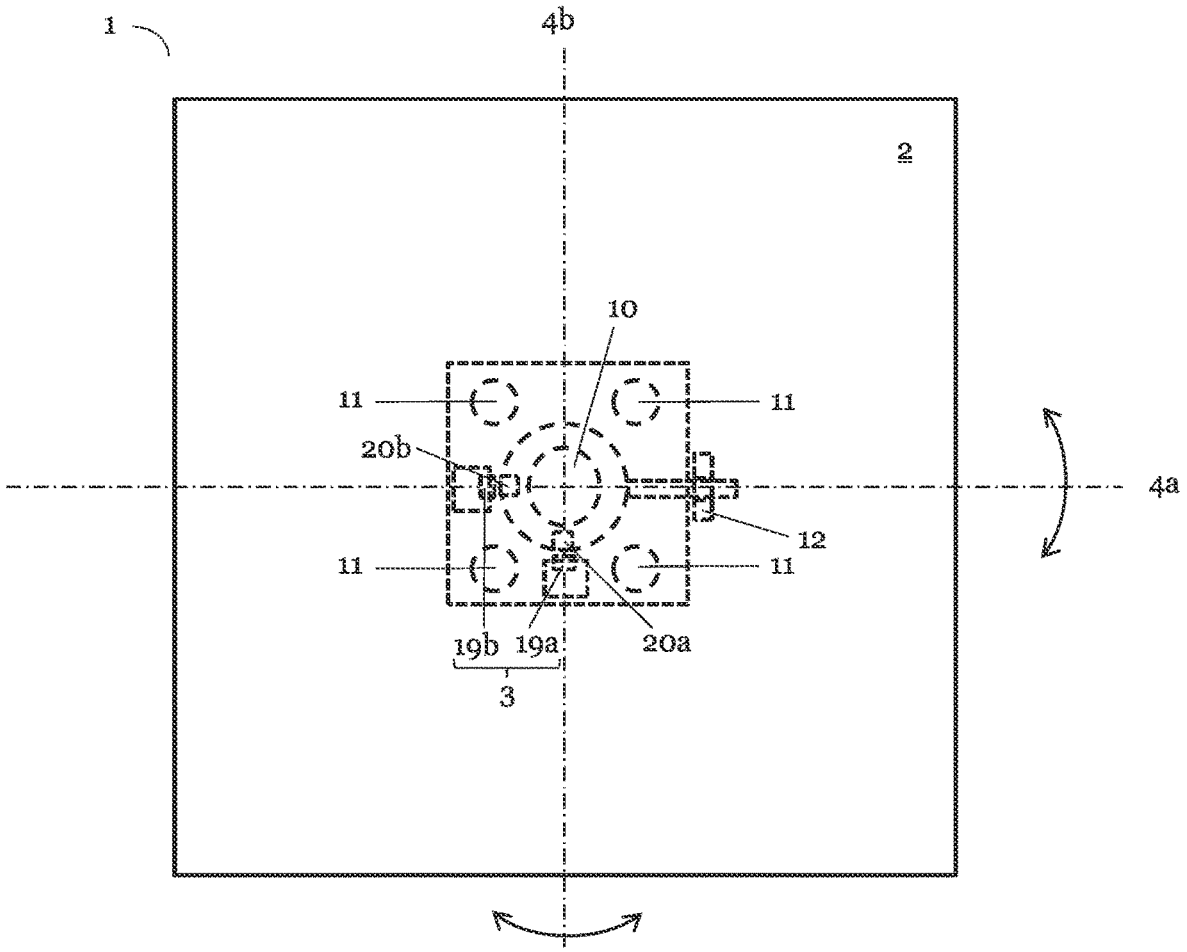
FIG. 3C shows a top view of control device (1) according to the embodiment of the present invention with a Cardan suspension [sic: ball joint], two Hall sensors, and two magnets.

As depicted in FIGS. 3A to 3C, the bearing (s) may comprise a spherical head (10) with a sphere or a spherical section. The rotation of tread plate (2) about first axis (4*a*) and about second axis (4*b*) is implemented in this case by spherical head (10). The spherical head (10) may be mechanically secured against rotating by a rotation lock (12) if only two axes are supposed to be active.

Figure 4A:
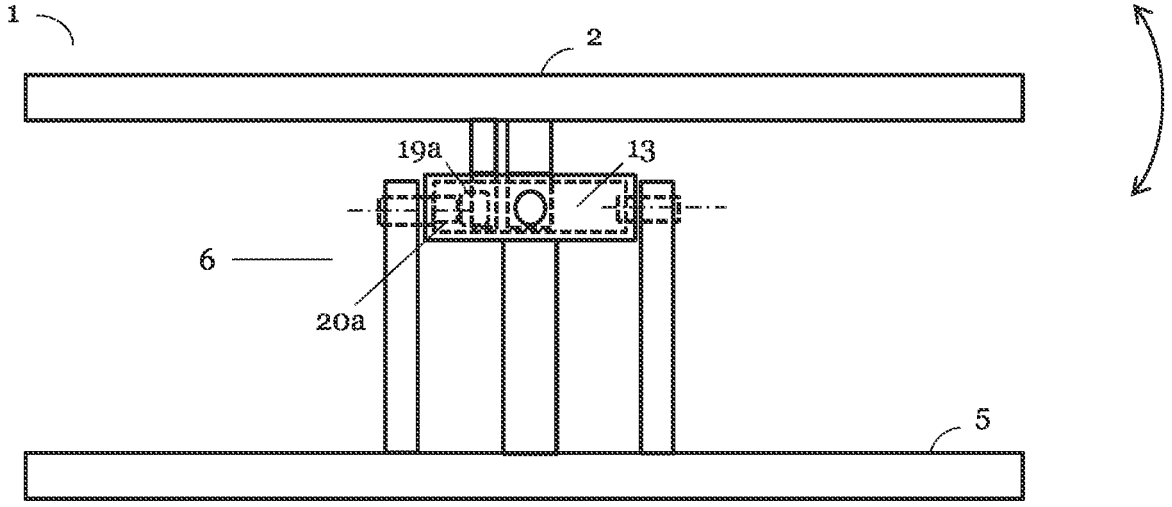
FIG. 4A shows a right side view of control device (1) according to one embodiment of the present invention with a Cardan suspension, two Hall sensors, and two magnets.
Figure 4B:
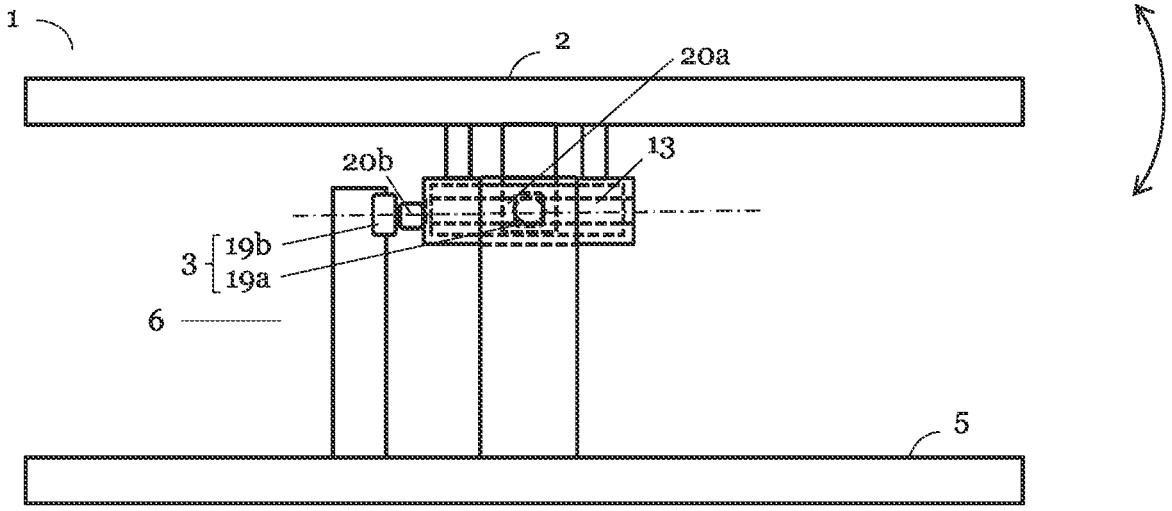
FIG. 4B shows a front view of control device (1) according to the embodiment of the present invention with a Cardan suspension, two Hall sensors, and two magnets.
Figure 4C:
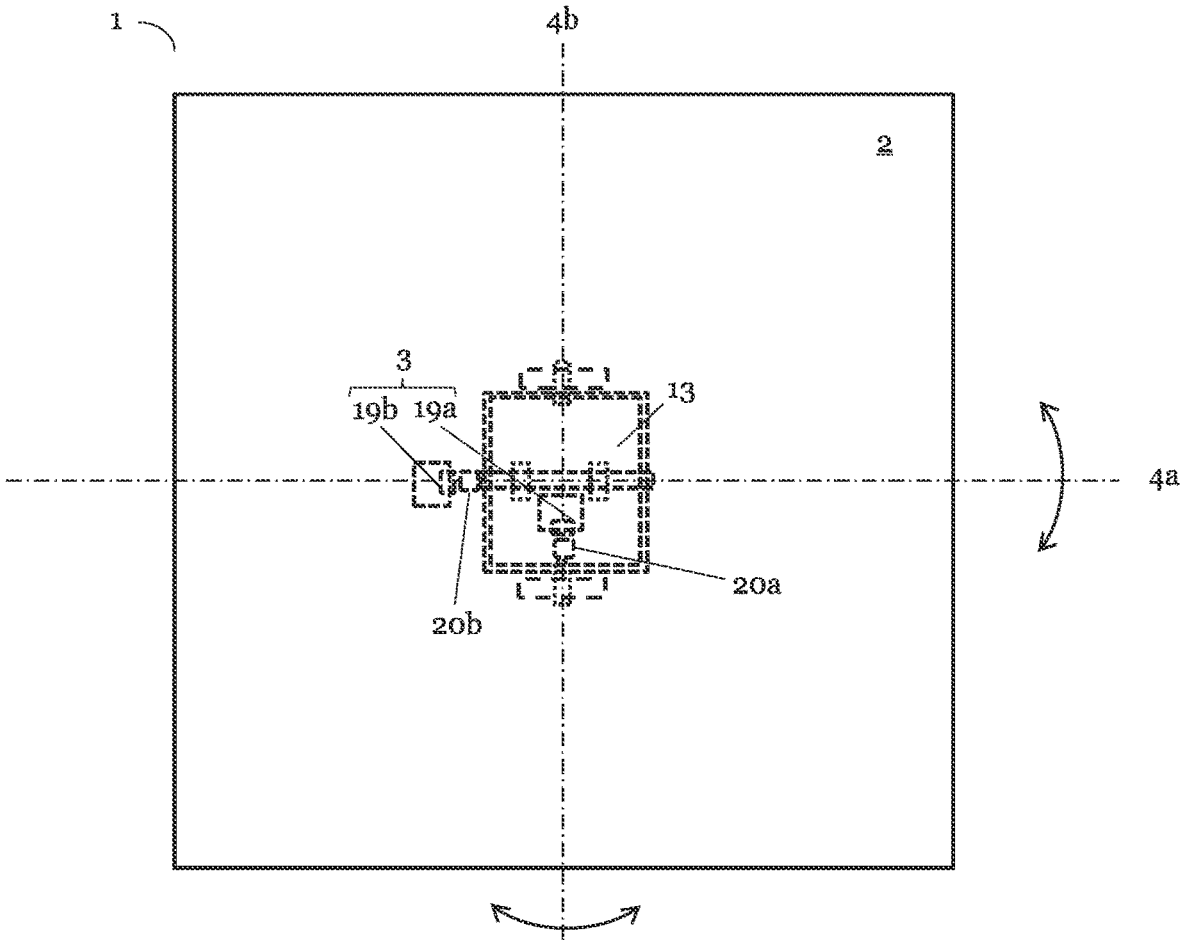
FIG. 4C shows a top view of control device (1) according to the embodiment of the present invention with a Cardan suspension, two Hall sensors, and two magnets.

As depicted in FIGS. 4A to 4C, bearing (6) may comprise a Cardan suspension with a first rotary bearing and a second rotary bearing, wherein the first rotary bearing is configured such that tread plate (2) is arranged to be rotatable about first axis (4*a*), and wherein the second rotary bearing is configured such that tread plate (2) is arranged to be rotatable about second axis (4*b*).

Furthermore, bearing (6) may comprise one or more slideways.

According to one aspect of the present invention, signal generator (3) may comprise a first signal generating element and a second signal generating element. The first signal generating element may be configured such that it generates the first signal based on a rotation of tread plate (2) about first axis (4*a*), and the second signal generating element may be configured such that it generates the second signal based on a rotation of tread plate (2) about second axis (4*b*).

Figure 2A:
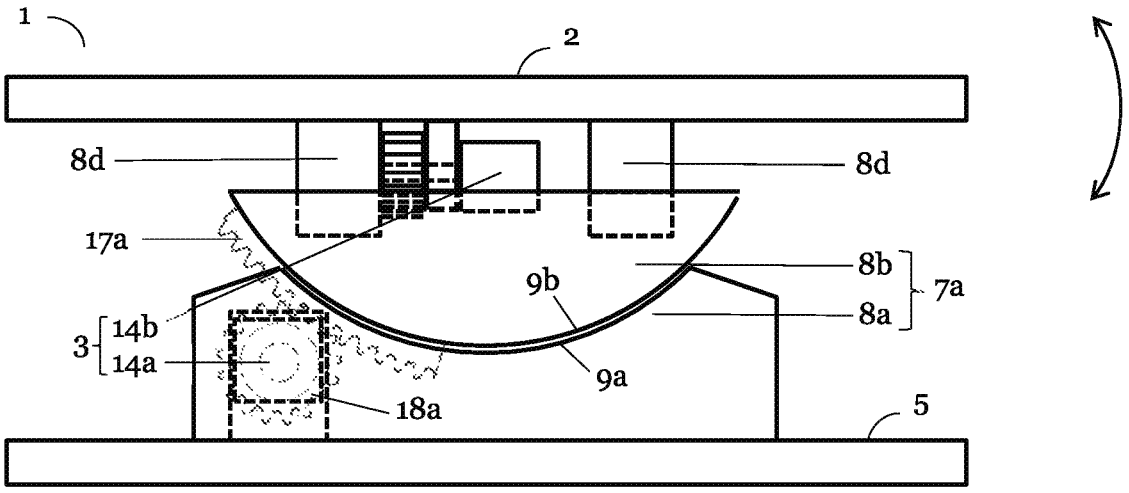
FIG. 2A shows a right side view of control device (1) according to one embodiment of the present invention with two articulations (7*a*, 7*b*), two potentiometers (14*a*, 14*b*), and two associated toothings.
Figure 2B:
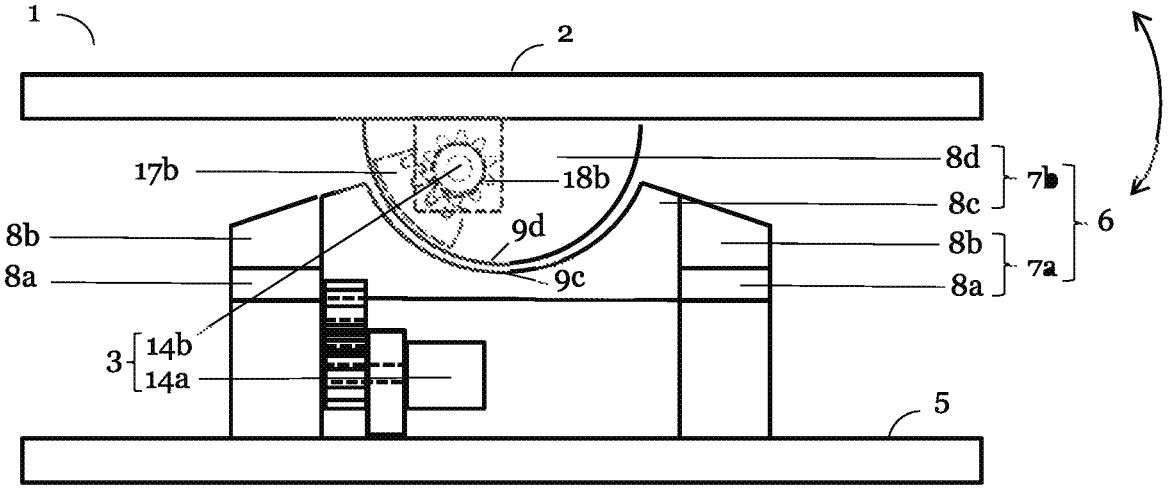
FIG. 2B shows a front view of control device (1) according to the embodiment of the present invention with two articulations (7*a*, 7*b*), two potentiometers (14*a*, 14*b*), and two associated toothings.

As depicted in FIGS. 1A to 2B, the first signal generating element may be a first potentiometer (14*a*) and/or the second signal generating element may be a second potentiometer (14*b*). As depicted in FIGS. 1A to 1E, first and second potentiometers (14*a*, 14*b*) may each be fixed to support surface (5). As depicted in FIGS. 2A to 2B, first and second potentiometers (14*a*, 14*b*) may each be fixed to tread plate (2) or to bearing (6).

As depicted in FIGS. 3A to 4C, the first signal generating element may be a first magnetic sensor or a Hall sensor (19*a*), and/or the second signal generating element may be a second magnetic sensor or a Hall sensor (19*b*). As depicted in FIGS. 3A to 3C, first and second Hall sensors (19*a*, 19*b*) may each be fixed to holder (11) or to support surface (5). As depicted in FIGS. 4A to 4C, first and second Hall sensors (19*a*, 19*b*) may each be fixed to bearing (6).

The control device may further comprise: a magnet (20*a*, 20*b*) associated with the respective Hall sensor (19*a*, 19*b*), wherein control device (1) is configured such that a position of the associated magnets (20*a*, 20*b*) relative to the respective Hall sensor (19*a*, 19*b*) changes when tread plate (2) rotates about the axis (4*a*, 4*b*) associated with the respective Hall sensor (19*a*, 19*b*), and control device (1) consequently causes the respective Hall sensor (19*a*, 19*b*) to change the output voltage depending on the position of the associated magnets (20*a*, 20*b*).

If, for example, first and/or second Hall sensor (19*a*, 19*b*) is fixed to holder (11) or to support surface (5), the associated magnet (20*a*, 20*b*) may be fixed to spherical head (10) or to bearing (6). If, for example, first and/or second Hall sensor (19*a*, 19*b*) is fixed to spherical head (10) or to bearing (6), the associated magnet (20*a*, 20*b*) may be fixed to holder (11) or to support surface (5). In this way, a position of the associated magnet (20*a*, 20*b*) changes relative to the respective Hall sensor (19*a*, 19*b*) when tread plate (2) rotates about the axis (4*a*, 4*b*) associated with the respective Hall sensor (19*a*, 19*b*), and control device (1) thereby causes the respective Hall sensor (19*a*, 19*b*) to change the output voltage depending on the position of the associated magnet (20*a*, 20*b*).

Furthermore, tread plate (2) may be arranged to rotate about a third axis, wherein the third axis extends perpendicular to tread plate (2), and wherein signal generator (3) is further configured such that it generates a third electric signal to control the sound, wherein the third electric signal is based on a rotation of tread plate (2) about the third axis.

The rotatable arrangement of tread plate (2) about the third axis may be implemented similarly as described above for the first and the second axes, for example, through a ball joint or through a Cardan suspension with a first rotary bearing, a second rotary bearing, and a third rotary bearing.

Figure 5A:
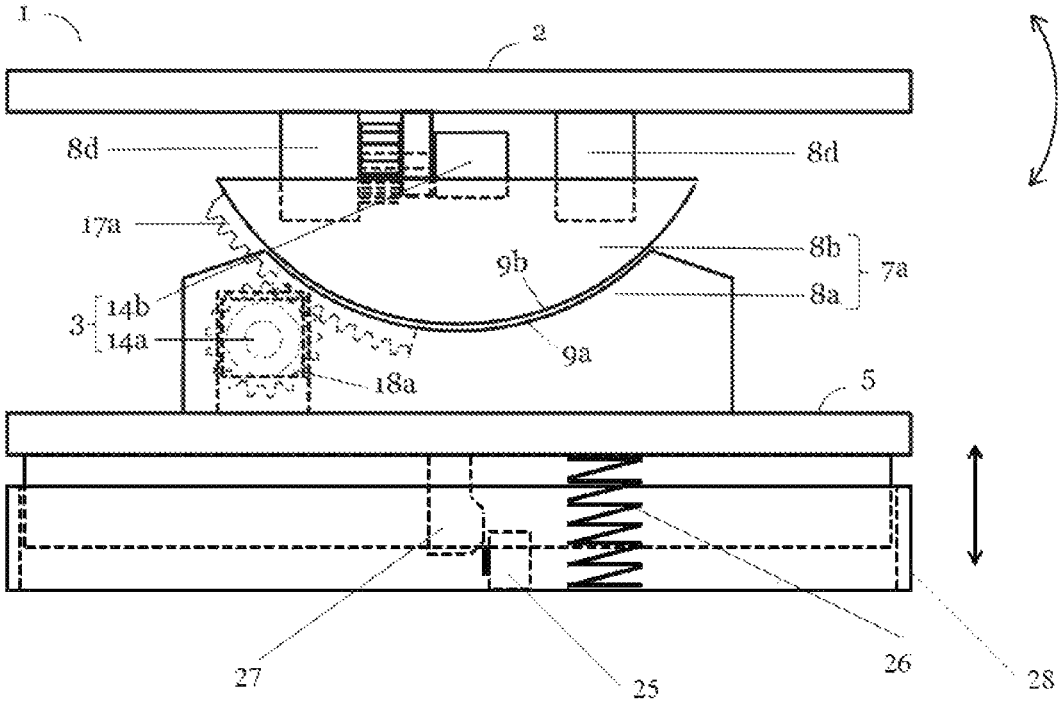
FIG. 5A shows a right side view of control device (1) according to various embodiments of the present invention with a spring (26) and a switch (25) which is mechanically actuated by a push rod (27). The embodiment is depicted according to FIG. 2A by way of example.
Figure 5B:
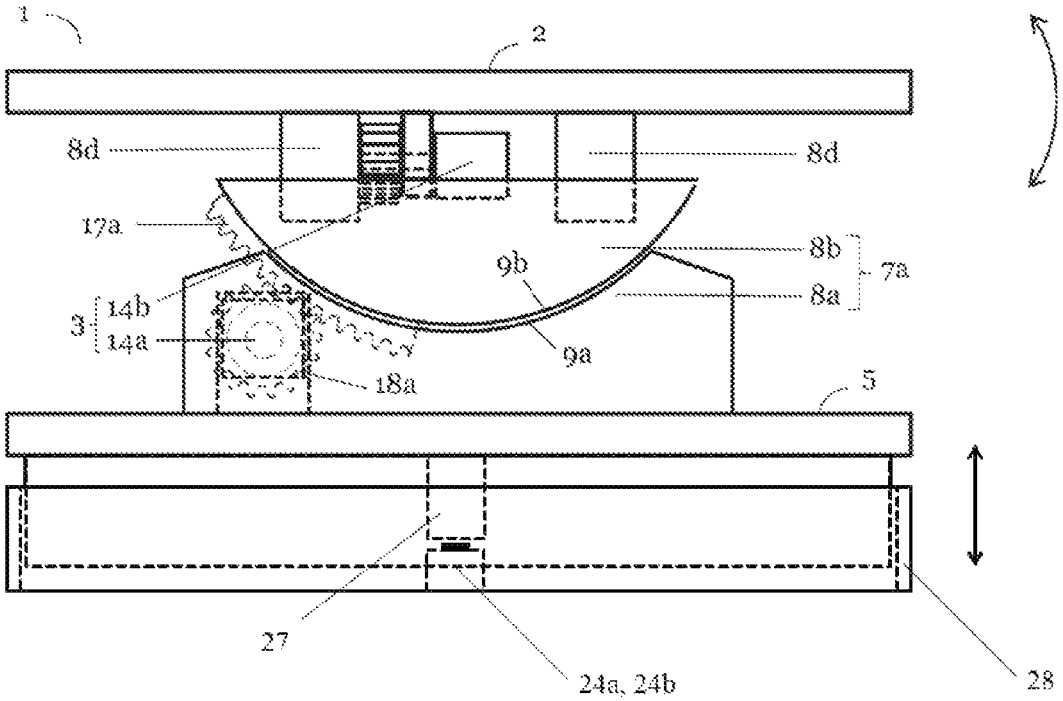
FIG. 5B shows a right side view of control device (1) according to various embodiments of the present invention with a first central force sensor (24*a*) for generating a third electric signal on the basis of a force acting vertically on the tread plate and/or a second central force sensor (24*b*) for executing a switching function. The embodiment is depicted according to FIG. 2A by way of example.

As depicted in FIG. 5A and FIG. 5B, the control device (a) may further comprise a base (28). The support surface (5) may be arranged to be movable with respect to the base in a direction perpendicular to support surface (5). As depicted in FIG. 5A, control device (1) may further comprise an elastic element (26), preferably one or more springs (26), wherein elastic element (26) is arranged in such a way between support surface (5) and base (28) that, when a force acts perpendicular to support surface (5), the force causes a deformation of elastic element (26). If elastic element (26) is compressed, elastic element (26) may be designed to provide a counter-force which acts on support surface (5).

In particular, support surface (2[sic:5]) may be initially arranged in a neutral position with respect to base (28), wherein support surface (2[sic:5]) has a defined distance from base (28) in the neutral position. The control device (1) may be configured such that support surface (2[sic:5]) automatically returns to the neutral position when no external force acts perpendicularly to tread plate (2). The automatic return of support surface (2[sic:5]) into the neutral position may be implemented by a reset mechanism, which comprises elastic element (26), preferably the one or more springs (26), as depicted in FIG. 5A. When an external force acts perpendicularly to tread plate (2), for example, when a user loads tread plate (2) with a foot, the external force may be transferred from tread plate (2) via bearing (6) to support surface (5). By this means, the distance between support surface (5) and base (28) may be reduced and the one or more springs (26) may be compressed. If the external force becomes smaller, for example, because the user reduces the load of tread plate (2), the one or more springs (26) press support surface (5) in the direction of the initial position, i.e., the neutral position of support surface (5) using their spring force. When the external force completely disappears, for example, because the user lifts the foot from tread plate (2), support surface (5) may automatically return into the neutral position with respect to base (28).

As depicted in FIG. 5A and FIG. 5B, control device (1) may further be equipped with a switch or touch function, which is activated by a vertical load of tread plate (2). Using this type of switch or touch function, control device (1) or the electric musical instrument may be switched on or off, for example.

For example, as depicted in FIG. 5B, control device (1) may comprise a second central force sensor (24*b*), which measures a force acting perpendicular to the tread plate and carries out the switch or touch function depending on the measured force. The second central force sensor (24*b*) may be arranged centrally with respect to tread plate (2). The control device (1) may further comprise a push rod (27), wherein push rod (27) is configured such that it transfers the force to second central force sensor (24*b*) when a force acts perpendicular to tread plate (2), and wherein second central force sensor (24*b*) is configured such that it measures the transferred force and carries out the switch or touch function based on the measured transferred force.

In particular, push rod (27) may be connected to support surface (5) and second central force sensor (24*b*) may be arranged completely or partially in base (28). In this case, a force acting perpendicular to tread plate (2) may be transferred via bearing (6) to support surface (5); support surface (5) may thereby move vertically in the direction of base (28) and/or push rod (27) may thereby exert a force on second central force sensor (24*b*); this force may be measured by second central force sensor (24*b*) and second central force sensor (24*b*) may carry out the switch or touch function depending on the measured force. Alternatively, second central force sensor (24*b*) may be connected to support surface (5) and push rod (27) may be arranged partially or completely in base (28).

Alternatively to second central force sensor (24*b*), the control device may comprise a switch (25) and a push rod (27) as depicted in FIG. 5A. When a force acts perpendicular to tread plate (2), push rod (27) may mechanically actuate switch (25) and thereby carry out the switching function. The push rod (27) and/or switch (25) may be arranged centrally with respect to tread plate (2).

In particular, push rod (27) may be connected to support surface (5) and switch (25) may be arranged partially or completely in base (28). Alternatively, switch (25) may be connected to support surface (5) and push rod (27) may be arranged partially or completely in base (28). When a force acts perpendicular to tread plate (2), it is transferred via the bearing to support surface (5); support surface (5) thereby moves vertically in the direction of base (28). A distance between push rod (27) and switch (25) is thereby reduced, and the switch is thereby mechanically actuated by push rod (27) in order to carry out the switching function.

In particular, control device (1) may be configured such that, during the execution of the switching function to switch off the control device, it generates a first electric reset signal and a second electric reset signal, wherein the first reset signal is configured such that it resets the first parameter of the sound to a first initial value, and wherein the second reset signal is configured such that it resets the second parameter of the sound to a second initial value In other words, a switch or push-button may be integrated into a base (28) of control device (1), which switches on the sound processing due to weight on the tread plate and/or resets the variable parameters to an initial value upon release. This switch or push-button may be either a mechanical switch or push-button or a sensor for an acting force or for contact, for example, a touch or capacitive [sensor]. In this way, the sound processing may be switched off as long as control device (1) is not operated. Thus, the user may use the sound control in a more targeted way as needed, and, in addition, energy may be saved and costs may be reduced.

As depicted in FIG. 5B, control device (1) may further comprise a first central force sensor (24*a*), which measures a force acting perpendicular to tread plate (2) or a weight force acting on tread plate (2), and causes signal generator (3) to generate a third electric signal to control the sound based on the measured force. The first central force sensor (24*a*) may be arranged, in particular, centrally with respect to tread plate (2). The control device (1) may further comprise a push rod (27), wherein push rod (27) is configured such that, it transfers the force to first central force sensor (24*a*) when a force acts perpendicular to tread plate (2), and wherein first central force sensor (24*a*) is configured such that it measures the transferred force and causes signal generator (3) to generate a third electric signal to control the sound based on the measured transferred force.

The push rod (27) may be connected to support surface (5) and first central force sensor (24*a*) may be arranged completely or partially in base (28). Alternatively, first central force sensor (24*a*) may be connected to support surface (5) and push rod (27) may be arranged completely or partially in base (28).

In particular, push rod (27) may be connected to support surface (5) and first central force sensor (24*a*) may be arranged completely or partially in base (28). In this case, a force acting perpendicular to tread plate (2) may be transferred via bearing (6) to support surface (5); support surface (5) may thereby move vertically in the direction of base (28) and/or push rod (27) may thereby exert a force on first central force sensor (24*a*); this force may be measured by first central force sensor (24*a*) and first central force sensor (24*a*) may cause signal generator (3) to generate the third electric signal to control the sound, depending on the measured force. Alternatively, first central force sensor (24*a*) may be connected to support surface (5) and push rod (27) may be arranged partially or completely in base (28).

5A Instead of first central force sensor (24*a*), control device (1) may also further comprise a signal spring, which is configured such that it is elastically deformed by a force acting perpendicular to tread plate (2) and causes the signal generator to generate a third electric signal to control the sound, based on the elastic deformation, preferably based on a change in length of the signal spring caused by the elastic deformation. The signal spring may be arranged, in particular, centrally with respect to tread plate (2). Furthermore, the signal spring may be connected to support surface (5) and may be arranged partially or completely in base (28). In particular, support surface (5) may be connected via the signal spring to base (28) and be arranged to be movable in the vertical direction with respect to the base. The signal spring may correspond with one of the previously-described one or more springs (26) of the reset mechanism of support surface (5) with respect to base (28), or be designed separately from the same.

It should be noted that control device (1) may contain both second central force sensor (24*a*[sic:24*b*]) or switch (25) and also first central force sensor (24*b*[sic:24*a*]) or the signal spring. A single force sensor may be used simultaneously for first central force sensor (24*a*) and the second central force sensor. Alternatively, first central force sensor (24*a*) and second central force sensor (24*b*) may be designed separately.

In other words, control device (1) may contain a suspension, which converts the spring path into an electric signal during weight loading of the tread plate. In this way, an additional parameter of the sound may be controlled by evaluating the movement in the direction perpendicular to the tread plate, similarly to a gas pedal.

Figure 6:
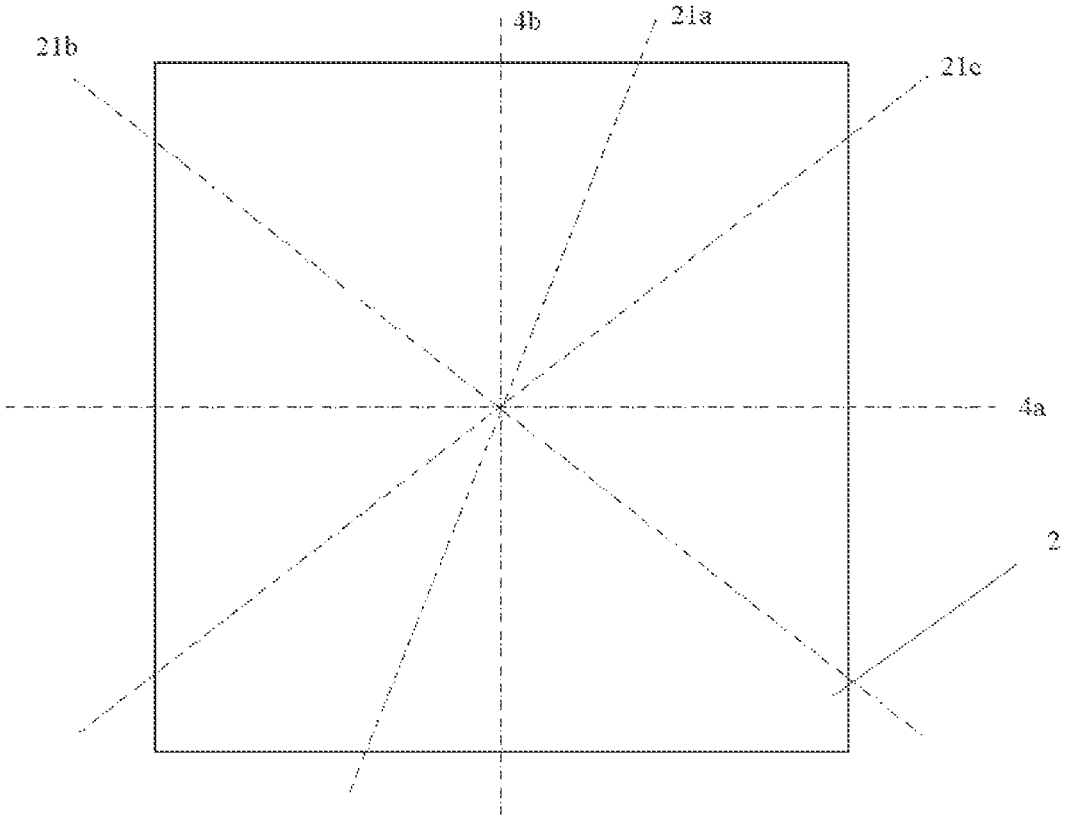
FIG. 6 shows a top view of control device (1) according to various embodiments of the present invention with one or more virtual axes (21*a*, 21*b*, 21*c*).

As depicted in FIG. 6, control device (1) may further control two or more parameters or control variables via multiple virtual axes (21*a*, 21*b*, 21*c*), which are calculated by electronics or software from input values.

In particular, control device (1) may comprise a signal converter, for example, electronics or software, wherein the signal converter is configured such that it converts the first electric signal and the second electric signal into a fourth electric signal to control the sound. The fourth electric signal may further be configured such that it controls a fourth parameter of the sound, wherein the fourth parameter may differ from the first parameter and/or the second parameter. The fourth electric signal may depend on a fourth angle of rotation of tread plate (2) about a virtual axis (21*a*, 21*b*, 21*c*), wherein virtual axis (21*a*, 21*b*, 21*c*) is arranged at a first virtual axis angle to first axis (4*a*) and at a second virtual axis angle to second axis (4*b*), wherein each of the first and the second virtual axis angles are greater than 0°. The virtual axis (21*a*, 21*b*, 21*c*) may extend parallel to tread plate (2) or define an axis angle with tread plate (2) which is greater than 0° and less than 90°. As depicted in FIG. 6, first axis (4*a*) and second axis (4*b*) may be arranged to be perpendicular to one another, and virtual axis (21*a*, 21*b*, 21*c*) may, for example, be arranged at an angle 45° to first axis (4*a*) and to second axis (4*b*) respectively.

In other words, by means of an intermediary electronics, additional signals may be obtained from the rotation of tread plate (2) about first axis (4*a*) and second axis (4*b*). The rotations of tread plate (2) about first axis (4*a*) and second axis (4*b*) may then be interpreted such that, during rotation of the tread plate about a virtual or imaginary axis, which is at an angle to the mechanical axes (4*a*, 4*b*), a certain parameter may be, for example, continuously changed.

In particular, the first, the second, and the fourth electric signals may be configured such that they respectively control a first, second, and fourth parameter of the sound. This means that, by rotating tread plate (2) about first axis (4*a*) and second axis (4*b*), the first, the second, and the fourth parameters may be simultaneously controlled. Even if control device (1) only has two mechanical axes (4*a*, 4*b*), numerous other sound effects may be generated by the intermediary electronics.

Alternatively, signal generator (3) may be configured such that, when tread plate (2) is rotated about virtual axis (21*a*, 21*b*, 21*c*), the signal generator does not generate the first electric signal and/or does not generate the second electric signal, but instead generates a fourth electric signal, wherein the fourth electric signal is based on a rotation of tread plate (2) about virtual axis (21*a*, 21*b*, 21*c*). The fourth signal may be configured such that it controls the fourth parameter of the sound. In other words, control device (1) may automatically recognize that the tread plate is rotated about a virtual axis (21*a*, 21*b*, 21*c*), which differs from first axis (4*a*) and second axis (4*b*), and correspondingly modify the signal generation in order to control the sound of the musical instrument, based on the rotation of the tread plate about virtual axis (21*a*, 21*b*, 21*c*), instead of based on the rotation of the tread plate about first axis (4*a*) and/or instead of based on the rotation of the tread plate about second axis (4*b*).

Furthermore, the signal converter may be configured such that it converts the first electric signal and the second electric signal into a plurality of fourth electric signals for controlling the sound, wherein each signal from the plurality of fourth electric signals is configured such that it controls one corresponding parameter from a plurality of fourth parameters of the sound. Each signal from the plurality of fourth signals may depend, in particular, on an angle of rotation of tread plate (2) about a corresponding virtual axis (21*a*, 21*b*, 21*c*) from a plurality of virtual axes (21*a*, 21*b*, 21*c*).

In other words, there may be multiple virtual axes, which each have a different angle with respect to axes 4*a* and 4*b*. The one or more virtual axes may be calculated by the signal converter, by electronics, or by software from input values. Thus, any arbitrary number of parameters of the sound may be simultaneously controlled. Thus, numerous new sound experiences may be created and the artistic expression may be intensified.

Figure 7:
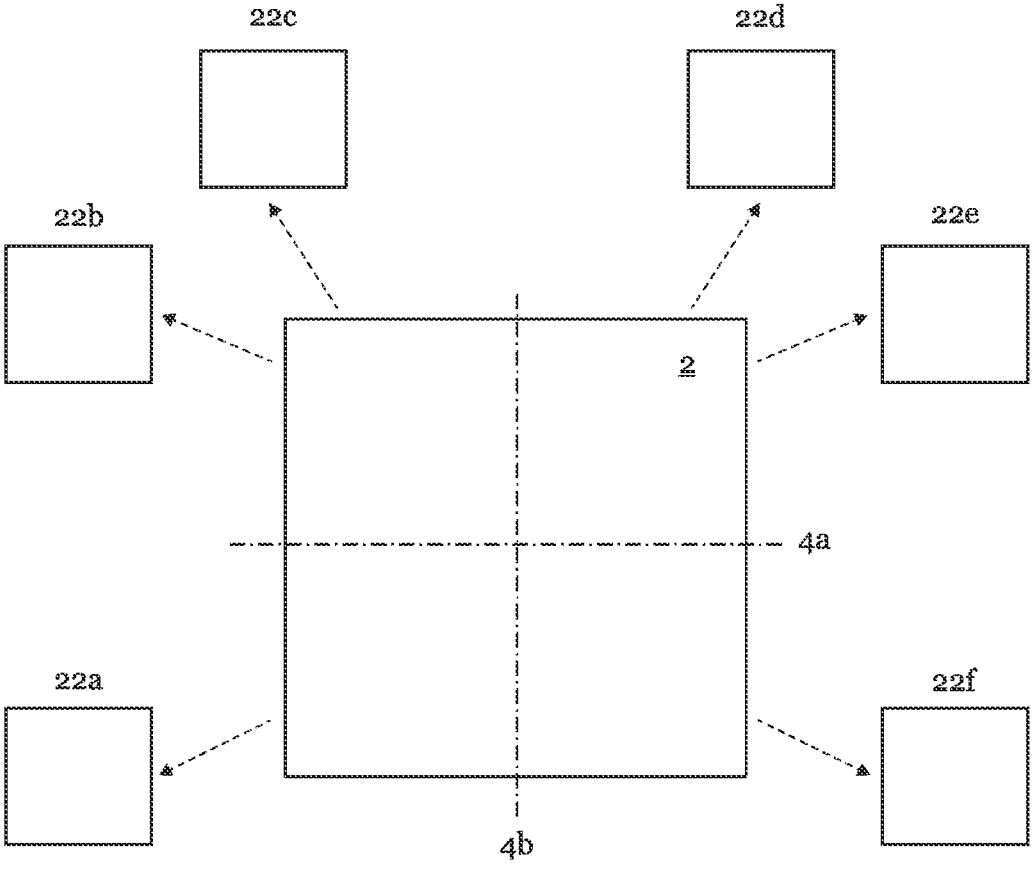
FIG. 7 shows a top view of control device (1) according to various embodiments of the present invention with one or more virtual zones (22*a*-22*f*).

As depicted in FIG. 7, a control device (1) according to the invention may further control two or more parameters or control variables via one or more virtual zones (22*a*-22*f*). In particular, control device (1) may comprise a signal converter which is configured such that it convers the first electric signal and the second electric signal into a fourth electric signal to control the sound. The sound of the electric musical instrument may be based on a plurality of sound effects, wherein each sound effect from the plurality of sound effects corresponds to one virtual zone (22*a*-22*f*) from a plurality of virtual zones (22*a*-22*f*), and wherein the fourth signal is configured such that it controls each sound effect from the plurality of sound effects depending on an inclination of the tread plate in the direction of the corresponding virtual zone (22*a*-22*f*).

In other words, control device (1) may be used as a virtual pedal board. In particular, multiple sound sources may be connected to control device (1) and each may be assigned to one virtual zone respectively, for example, to one imaginary position around control device (1) standing, for example, on the floor. By inclining the tread plate in a certain direction, the corresponding sound source is activated or mixed in. Adjacent positions may thereby automatically influence each other. When, for example, the tread plate is inclined in a certain direction, all those sound sources may be activated which are approximately assigned to the certain direction. In this way, the user may simultaneously control a plurality of sounds or sound effects in an easy and effective way.

Figure 8:
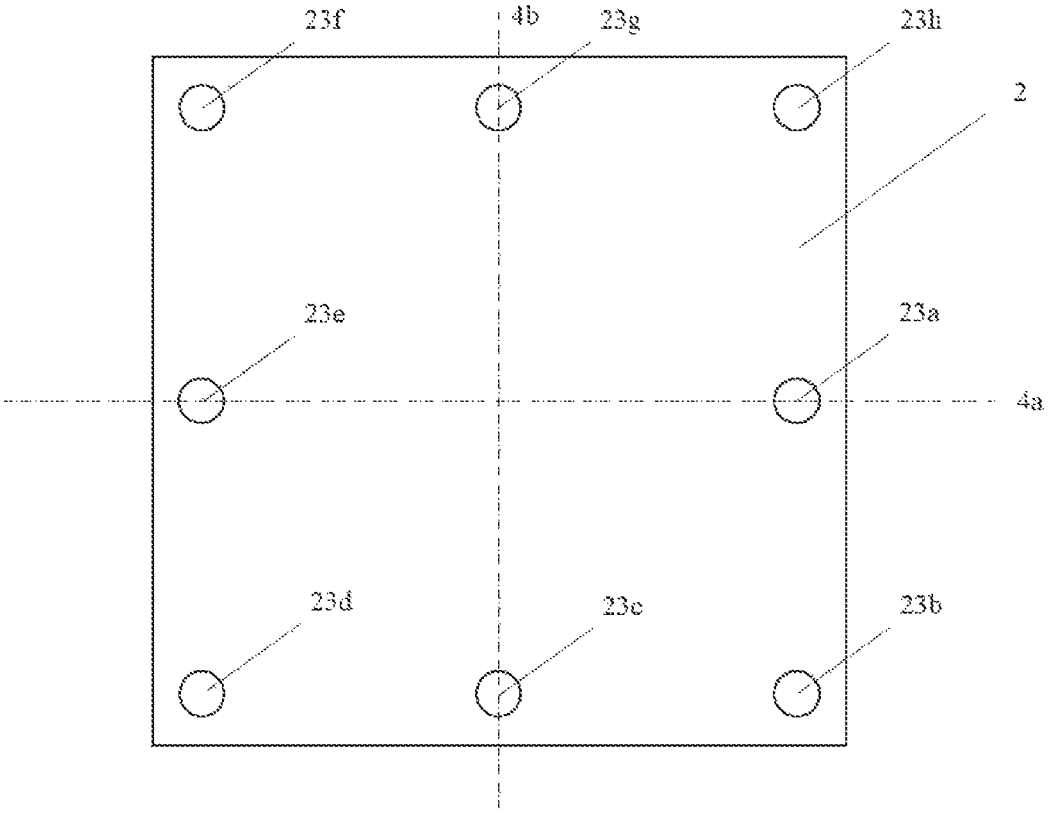
FIG. 8 shows a top view of control device (1) according to various embodiments of the present invention with force sensors (23*a*-23*h*), which are arranged on tread plate (2) of control device (1).

As depicted in FIG. 8, a control device (1) according to the present invention may further comprise one or more force sensors (23*a*-23*h*) arranged on the tread plate, wherein each force sensor (23*a*-23*h*) is configured such that it measures a force acting on tread plate (2) at the position of the respective force sensor (23*a*-23*h*), and wherein signal generator (3) is configured such that it generates a respective electric signal to control the sound based on the force measured by the respective force sensor (23*a*-23*h*). The respective electric signal may be configured such that it controls a respective parameter of the sound, which may differ from the first and/or the second parameter. The parameters corresponding to the respective force sensors (23*a*-23*h*) may be identical to each other or differ from one another.

In other words, signals are generated by an exertion or force or weight on tread plate (2) in addition to the rotary movements across the two axes (4*a*, 4*b*). The higher the force or the weight is on a point of the tread plate, at which a force sensor is located (23*a*-23*h*), the stronger the corresponding signal may be for controlling the sound. The evaluation of the force signals may be carried out continuously and may be respectively assigned to an additional parameter.

In particular, in the case of a control device (1) with force sensors (23*a*-23*h*) as described above, signal generator (3) may be configured such that it only generates the respective electric signal to control the sound when tread plate (2) is inclined past a respective stop angle in the direction of the respective force sensor (23*a*-23*h*). In other words, the evaluation of the force signals may only show its effect at the end stop of the rotary movements of the pedal. Furthermore, the one or more force sensors (23*a*-23*h*) may each be arranged on the edge of tread plate (2), wherein the plurality of force sensors (23*a*-23*h*) may, in particular, be arranged at uniform distances or identical angular distances with respect to an axis (4*a*, 4*b*) along the edge of tread plate (2). For example, control device (1) may comprise eight force sensors (23*a*-23*h*), which are respectively arranged at an angle of 0°, 45°, 90°, 135°, 180°, 225°, 270°, or 315° with respect to first axis (4*a*), as depicted in FIG. 8.

For example, the rotations about the two axes (4*a*, 4*b*) may respectively control a filter and an intensity of a modulation effect, and the weight force applied to tread plate (2) and measured by the force sensors (23*a*-23*h*) might add an echo. In the case of a variant with force sensors (23*a*-23*h*) on the edge of the tread plate, the end stop may cause a specific emphasis, for example, that the filter switches into resonance and the modulation effect increases in speed.

The control device (1) may further be configured such that it allows an electronic implementation as follows: i) an electrical resistance is deduced from a potentiometer for use as an expression pedal, and/or ii) an electrical resistance from a potentiometer is used for mixing two signals, and/or iii) an electrical resistance from a potentiometer is used to control an integrated effects electronics, and/or iv) sensor signals from the magnetic sensors, Hall sensors, photoelectric elements or piezo elements are evaluated analogically or digitally and control an integrated effects electronics, and/or v) sensor signals from the magnetic sensors, Hall sensors, photoelectric elements or piezo elements are digitally evaluated and converted into a control protocol for external effects devices (e.g., MIDI Control Change or SysEx).

According to another aspect of the present invention, a rotation of tread plate (2) actuates one or more potentiometers, which are used as expression inputs for effects devices. According to another aspect of the present invention, a rotation of tread plate (2) is recorded via sensors and converted into a digital control protocol, which controls digital devices. According to another aspect of the present invention, the electric signals function to control an electric switch installed in the electric musical instrument.

It should be noted that the different variants of the individual components of control device (1), which were described above, may be arbitrarily combined with one another. For example, bearing (6), as described above, may be implemented by a first and second articulation (7*a*, 7*b*), by a ball joint with a spherical head (10) and a holder (11), or by a Cardan suspension (13), and the first and/or second signal generating element may be implemented by a respective potentiometer (14*a*, 14*b*), a rotary encoder, a Hall sensor (19*a*, 19*b*), a photo electric element, or a piezo element. Each of these implementations of bearing (6) may be combined with each of these implementations of the first signal generating element and with each of these implementations of the second signal generating element. Furthermore, each combination of these implementations may be combined with each of the electronic implementations i) to iv) described above.

It should be further noted, that the tread plate may have any arbitrary shape. For example, the tread plate may be square, rectangular, round, oval, or adapted to the shape of a human foot.

It should be further noted, that control device (1) may control the sound of the musical instrument through the force sensors (23*a*-23*h*) described above and/or through the rotation of tread plate (2) about the two axes (4*a*, 4*b*). This means that control device (1) may also control the sound of the musical instrument only using the force sensors (23*a*-23*h*) described above and not using a rotation of tread plate (2) about the two axes (4*a*, 4*b*). In other words, tread plate (2) does not have to be arranged to be rotatable about the two axes (4*a*, 4*b*) and control device (1) may control the sound of the musical instrument exclusively using the force sensors (23*a*-23*h*) described above.

This means that, according to one aspect of the present invention, a control device (1) for controlling a sound of an electric musical instrument comprises: a tread plate (2); a plurality of force sensors (23*a*-23*h*) arranged on the tread plate; and a signal generator (3), which is configured such that it generates a plurality of electric signals for controlling the sound, wherein each force sensor (23*a*-23*h*) from the plurality of force sensors (23*a*-23*h*) is configured such that it measures a force acting on tread plate (2) at the position of the respective force sensor (23*a*-23*h*) and causes signal generator (3) to generate a corresponding signal from the plurality of signals which is based on the force measured by the respective force sensor (23*a*-23*h*). It should be noted that all other aspects of the control device described herein are also combinable with a control device (1) according to this aspect.

The one or more force sensors (23*a*-23*h*) on tread plate (2), first central force sensor (24*a*), and/or second central force sensor (24*b*) may each be implanted, for example, by piezo elements or strain gauges. It should be noted that the one or more force sensors (23*a*-23*h*), first central force sensor (24*a*), and/or second central force sensor (24*b*) may also be designated as one or more pressure sensors (23*a*-23*h*), a first central pressure sensor (24*a*) or a second central pressure sensor (24*b*).

The control device may, in particular, be designated as a foot pedal or as an electronic device for foot operation. Furthermore, an electric musical instrument may be an electric musical instrument or an electrically amplified musical instrument or a sound-shaping device. Correspondingly, a first and a second axis may be, in particular, a transverse axis and a longitudinal axis. Examples for the control of a sound comprise the control of a frequency of a filter and the control of an intensity of a distortion. A parameter of a sound may, in particular, be a control variable, and an electric signal may, for example, indicate an electric variable. In particular, the present invention relates to an electronic device for foot operation, in which a tread plate on an upper side may be moved in at least two degrees of freedom: rotation about a transverse axis and about a longitudinal axis. The movement may take place across all axes independently from one another. The effect of the mechanical movement is thereby converted into electric variables, which a sound-shaping device or an incorporated filter may then control. A movement about the transverse axis controls, for example, a frequency of a filter, and a movement about the longitudinal axis controls, for example, an intensity of a distortion.

LIST OF REFERENCE NUMERALS

1 Control device
2 Tread plate
3 Signal generator
4*a*, 4*b* Axis
5 Support surface
6 Bearing
7*a*, 7*b* Articulation
8*a*, 8*b*, 8*c*, 8*d* Articulation element
9*a*, 9*b*, 9*c*, 9*d* Sliding surface
10 Spherical head
11 Holder
12 Rotation lock
13 Cardan suspension
14*a*, 14*b* Potentiometer
15*a*, 15*b* Bowden cable
16*a*, 16*b* Deflection
17*a*, 17*b*, 18*a*, 18*b* Toothing element
19*a*, 19*b* Hall sensor
20*a*, 20*b* Magnet
21*a*, 21*b*, 21*c* Virtual axis
22*a*-22*f* Virtual zone
23*a*-23*h* Force sensor
24*a* First central force sensor
24*b* Second central force sensor
25 Switch
26 Elastic element, spring
27 Push rod
28 Base

What is claimed is:

1. Control device for controlling a sound of an electric musical instrument, the control device comprising:

a tread plate which is arranged to be rotatable about a first axis and is arranged to be rotatable about a second axis; and a signal generator which is configured such that it generates a first electric signal to control the sound and a second electric signal to control the sound, wherein the first electric signal is based on a rotation of the tread plate about the first axis and the second electric signal is based on a rotation of the tread plate about the second axis;

a support surface; and a bearing which connects the tread plate to the support surface so that the tread plate is rotatable about the first axis and about the second axis, wherein the first axis and the second axis each extend parallel to the tread plate, wherein the first axis and the second axis are arranged perpendicular to one another, wherein the bearing comprises a first articulation and a second articulation, wherein the first articulation is configured such that the tread plate is arranged to be rotatable about the first axis, and wherein the second articulation is configured such that the tread plate is arranged to be rotatable about the second axis;

wherein the signal generator comprises a first signal generating element, which is configured such that it generates the first signal based on a rotation of the tread plate about the first axis, wherein the signal generator comprises a second signal generating element, which is configured such that it generates the second signal based on a rotation of the tread plate about the second axis, wherein the first signal generating element is a first potentiometer and/or the second signal generating element is a second potentiometer, wherein the respective potentiometer is configured such that an electrical resistance therein changes depending on an angle of rotation of the tread plate about the axis associated with the respective potentiometer, and that the signal, associated with the respective potentiometer, is based on the changed electrical resistance of the potentiometer, and, wherein:

i) the control device further comprises a Bowden cable, with an associated cable and an associated deflection, associated with the respective potentiometer, wherein the respective potentiometer and the deflection are fixed to the support surface, and wherein the cable is fixed at its two ends to the tread plate and runs around the deflection and the respective potentiometer, and wherein the Bowden cable is configured such that the length of the cable between a fixing point of the cable to the tread plate and the respective potentiometer changes when the tread plate rotates about the axis associated with the respective potentiometer, and the Bowden cable thereby causes the respective potentiometer to change the electrical resistance depending on the length of the cable between the fixing point and the respective potentiometer;

or ii) the control device further comprises a toothing, with an associated first toothing element and an associated second toothing element, associated with the respective potentiometer, wherein the first toothing element is fixed to the bearing and the second toothing element is fixed to the respective potentiometer, wherein the first toothing element is configured such that it rotates when the tread plate rotates about the axis associated with the respective potentiometer, and wherein the second toothing element is configured such that it rotates when the first toothing element rotates, and the second toothing element thereby causes the respective potentiometer to change the electrical resistance depending on the angle of rotation of the tread plate about the axis associated with the respective potentiometer.

2. Control device according to claim 1, wherein the signal generator is configured such that it generates the first signal as a reaction to the rotation of the tread plate about the first axis and generates the second signal as a reaction to the rotation of the tread plate about the second axis.

3. Control device according to claim 1, wherein the first signal is independent of the rotation of the tread plate about the second axis and the second signal is independent of the rotation of the tread plate about the first axis.

4. Control device according to claim 1, which is further configured such that the tread plate automatically returns to a neutral position when no external torque acts on the tread plate, wherein the tread plate in the neutral position is preferably arranged parallel to the support surface.

5. Control device according to claim 1, wherein the first signal generating element is a first potentiometer, a first rotary encoder, a first Hall sensor, a first light sensor, a first photoelectric element, or a first piezo element, and/or wherein the second signal generating element is a second potentiometer, a second rotary encoder, a second Hall sensor, a second light sensor, a second photoelectric element, or a second piezo element.

6. Control device according to claim 1, wherein the first signal generating element is a first Hall sensor and/or the second signal generating element is a second Hall sensor, and wherein the respective Hall sensor is configured such that an output voltage of the same changes depending on an angle of rotation of the tread plate about the axis associated with the respective Hall sensor, and the signal associated with the respective Hall sensor is based on the changed output voltage of the respective Hall sensor.

7. Control device according to claim 1, wherein the tread plate is further arranged to be rotatable about a third axis, wherein the third axis extends perpendicular to the tread plate, and wherein the signal generator is further configured such that it generates a third electrical signal to control the sound, wherein the third electrical signal is based on a rotation of the tread plate about the third axis.

8. Control device according to claim 1, wherein the sound is based on a first sound effect and a second sound effect, wherein the first sound effect and the second sound effect differ from one another, and wherein the first electrical signal is configured such that it controls or affects the first sound effect, and the second electrical signal is configured such that it controls or affects the second sound effect.

9. Control device according to claim 1, which further comprises:

a signal converter, which is configured such that it converts the first electrical signal and the second electrical signal into a fourth electrical signal to control the sound, preferably wherein the fourth electrical signal is configured such that it controls a fourth parameter of the sound, wherein the fourth parameter differs from the first parameter and/or the second parameter.

10. Control device according to claim 9, wherein the fourth electrical signal depends on a fourth angle of rotation of the tread plate about a virtual axis, wherein the virtual axis is arranged at a first virtual axis angle to the first axis and at a second virtual axis angle to the second axis, wherein each of the first and second virtual axis angles is greater than 0°.

11. Control device according to claim 9, wherein the sound is based on a plurality of sound effect, wherein each sound effect from the plurality of sound effects corresponds to a virtual zone from a plurality of virtual zones, and wherein the fourth signal is configured such that it controls or affects each sound effect from the plurality of sound effects depending on an inclination of the tread plate in the direction of the corresponding virtual zone.

12. Control device according to claim 1, which further comprises:

a signal converter, which is configured such that it converts the first electrical signal and the second electrical signal into a plurality of fourth electrical signals to control the sound, wherein each signal from the plurality of fourth electric signals is configured such that it controls one corresponding parameter from a plurality of fourth parameters of the sound, and wherein each signal from the plurality of fourth signals preferably depends on an angle of rotation of the tread plate about a corresponding virtual axis from a plurality of virtual axes.

13. Control device according to claim 1, wherein the first axis has a first distance to the tread plate and the second axis has a second distance to the tread plate, wherein i) the first distance equals the second distance, and/or ii) the first distance and/or the second distance is equal to zero.

14. A control system, which comprises a control device according to claim 1 and the electric musical instrument.

15. The control device according to claim 1, wherein the first toothing element is a first gear or a first gear segment and the second toothing element is a second gear or second gear segment.

16. The control device according to claim 1, wherein the first electric signal is configured to control a first parameter of the sound and the second electric signal is configured to control a second parameter of the sound, wherein the first and second parameters of the sound differ from one another, such that the first parameter is continuously changed by continuously changing the first angle of rotation and the second parameter is continuously changed by continuously changing the second angle of rotation.

17. Control device according to claim 1, wherein the first signal depends on a first angle of rotation of the tread plate about the first axis and the second signal depends on a second angle of rotation of the tread plate about the second axis.

18. Control device according to claim 1, wherein the first signal is configured such that it controls a first parameter of the sound, and the second signal is configured such that it controls a second parameter of the sound, wherein the first and second parameters of the sound differ from one another.

* * * * *